US010145099B2

(12) United States Patent
Jarman et al.

(10) Patent No.: US 10,145,099 B2
(45) Date of Patent: Dec. 4, 2018

(54) FLOW CONTROL ASSEMBLY

(71) Applicant: Hydro International plc, Clevedon (GB)

(72) Inventors: Daniel Stuart Jarman, Somerset (GB); Anthony Tadek Leslie Kolanko, Bristol (GB)

(73) Assignee: Hydro International PLC, Clevedon (GB)

( * ) Notice: Subject to any disclaimer, the term of this patent is extended or adjusted under 35 U.S.C. 154(b) by 55 days.

(21) Appl. No.: 15/116,156

(22) PCT Filed: Jan. 19, 2015

(86) PCT No.: PCT/GB2015/050103
§ 371 (c)(1),
(2) Date: Aug. 2, 2016

(87) PCT Pub. No.: WO2015/118296
PCT Pub. Date: Aug. 13, 2015

(65) Prior Publication Data

US 2017/0167622 A1 Jun. 15, 2017

(30) Foreign Application Priority Data

Feb. 5, 2014 (GB) ..... 1401926.9

(51) Int. Cl.
*E03F 5/00* (2006.01)
*E03F 5/10* (2006.01)
*F15D 1/00* (2006.01)

(52) U.S. Cl.
CPC ..... *E03F 5/106* (2013.01); *F15D 1/0015* (2013.01)

(58) Field of Classification Search
CPC .. E03F 5/106; F15D 1/0015; Y10T 137/2087; Y10T 137/2098;
(Continued)

(56) References Cited

U.S. PATENT DOCUMENTS 4,846,224 A * 7/1989 Collins, Jr. ..... F15C 1/16 137/810
4,889,166 A * 12/1989 Lakatos ..... E03F 5/106 137/810

(Continued)

FOREIGN PATENT DOCUMENTS

NL 1036953 C 10/2010
WO WO-2013038398 A1 3/2013

OTHER PUBLICATIONS

International Search Report for Application PCT/GB2015/050103 dated Jun. 8, 2015.

(Continued)

*Primary Examiner* — Eric Keasel
(74) *Attorney, Agent, or Firm* — Honigman Miller Schwartz and Cohn LLP

(57) ABSTRACT

A flow control assembly comprising: a mounting bracket attachable to a wall of a collection chamber, the mounting bracket having an opening extending therethrough; a flow control module detachably coupled to the mounting bracket, the flow control module having an inlet and an outlet, the outlet being aligned with the opening of the mounting bracket; and a gasket having an opening extending therethrough, the opening being smaller than the outlet of the flow control module and the opening of the mounting bracket. The gasket is disposed between the flow control module and the mounting bracket so as to seal the flow control module against the mounting bracket, with the opening of the gasket aligned with the outlet of the flow control module and the opening of the mounting bracket so as to restrict flow out of the flow control module. Also described is a corresponding kit of parts and method of installation.

25 Claims, 4 Drawing Sheets

(58) Field of Classification Search
CPC ..... Y10T 137/2104; Y10T 137/2109; Y10T 137/2115
USPC ..... 137/808, 810, 811, 812, 813
See application file for complete search history.

(56) References Cited

U.S. PATENT DOCUMENTS 5,080,137 A 1/1992 Adams
5,303,782 A * 4/1994 Johannessen ..... E03F 5/106 137/809
5,337,789 A * 8/1994 Cook ..... E03F 5/106 137/810
5,913,334 A * 6/1999 Hyun ..... B04C 5/12 137/810
6,082,925 A * 7/2000 Raasch ..... E03F 5/106 137/808
6,406,216 B1 * 6/2002 Raasch ..... E03F 5/106 137/808
7,814,935 B2 * 10/2010 Andoh ..... F16L 37/133 137/813
8,511,714 B2 * 8/2013 Marquis-Martin ..... E03F 5/106 137/808
8,555,924 B2 * 10/2013 Faram ..... E03F 5/106 137/812
8,757,667 B2 * 6/2014 Marquis-Martin ..... E03F 5/106 137/808
8,919,382 B2 * 12/2014 Johannessen ..... E03F 5/106 137/810
2012/0098254 A1 4/2012 Marquis-Martin

OTHER PUBLICATIONS

U.K. Search Report for Application GB1401926.9 dated Jul. 22, 2014.

* cited by examiner

FLOW CONTROL ASSEMBLY

TECHNICAL FIELD

The invention relates to a flow control assembly and particularly, but not exclusively, to a flow control assembly which comprises a vortex flow control device. The invention also relates to a corresponding kit of parts and method of installation.

BACKGROUND

Vortex flow control devices, or "vortex valves", are used, for example in sewerage systems, for controlling fluid flow by a hydraulic effect without requiring moving parts. Such devices have a vortex chamber provided with an outlet at one axial end and an inlet arranged to cause a circulating flow in the vortex chamber which creates a vortex when a certain hydraulic condition has been attained.

At low flow rates, water entering through the inlet of a vortex flow control device passes through the vortex chamber to the outlet with substantially no pressure drop. At high flow rates, water enters through the inlet with enough energy to create a vortex in the vortex chamber which results in a significant pressure drop between the inlet and the outlet, thus restricting flow through the outlet. Therefore, the vortex flow control device automatically limits the rate of flow. Vortex flow control devices can be used, for example, to control the flow of stormwater in sewers such that equipment downstream of the device is not overloaded during periods of heavy rainfall.

Vortex flow control devices are commonly installed in a collection chamber (defined by a gully or manhole) in which rain water, drained from road surfaces and other paved areas, collects. An outlet pipe extends from a wall of the collection chamber to a sewer, and the vortex flow control device is mounted so that its outlet makes a water-tight connection with the end of the outlet pipe.

The hydraulic characteristics of a vortex flow control device can be controlled by varying the dimensions of the device. For example, the vortex chamber, inlet and outlet dimensions may be adjusted to tailor the flow rate at which a vortex initiates within the device. Accordingly, a vortex flow control device can be customized to suit the specific application in which it is to be used.

Similar customization may also be required for other devices installed in a collection chamber. For example, the dimensions of a filter module may be configured to define a residence time within the filter.

In general, such customization is both costly and time consuming, and is not easily altered once the device has been installed in the collection chamber.

The present invention seeks to provide an arrangement whereby customization of a vortex flow control device and other flow control modules is more readily achieved.

SUMMARY

In accordance with an aspect of the invention, there is provided a flow control assembly comprising: a mounting bracket attachable to a wall of a collection chamber, the mounting bracket having an opening extending therethrough; a flow control module detachably coupled to the mounting bracket, the flow control module having an inlet and an outlet, the outlet being aligned with the opening of the mounting bracket; and a gasket having an opening extending therethrough, the opening being smaller than the outlet of the flow control module and the opening of the mounting bracket; wherein the gasket is disposed between the flow control module and the mounting bracket so as to seal the flow control module against the mounting bracket, with the opening of the gasket aligned with the outlet of the flow control module and the opening of the mounting bracket so as to restrict flow out of the flow control module.

As described, the gasket has dual functions: sealing the vortex flow control module against the mounting bracket and controlling the hydraulic characteristics of the flow control module by restricting the flow out of the flow control module.

The gasket may be supplied without the opening and this may be cut during installation based on the expected flow conditions. Alternatively, a plurality of gaskets may be supplied, each having a different sized opening, and the appropriate gasket selected before installation.

The gasket allows the characteristics of the flow control module to be quickly and easily altered. The flow control module can therefore be manufactured and supplied in a standard size (or a more limited range of sizes), with adjustment being provided by the gasket. The gasket is a relatively inexpensive component and can therefore be replaced whenever necessary.

The flow control module may comprise a vortex flow control device, with the inlet and outlet opening into a vortex chamber of the vortex flow control device.

The mounting bracket and the flow control module may be detachably coupled by a connection comprising male and female interlocking portions.

The female interlocking portion may comprise a receiving slot and the male interlocking portion comprises a complementary mounting element which is slidably received within the receiving slot.

The female interlocking portion may comprise a pair of jaws which are spaced from one another to define an open throat therebetween. Each of the jaws may comprise a groove, the grooves opposing one another to define the receiving slot.

The receiving slot and mounting element may each taper along their length such that a lower portion has a smaller dimension than an upper portion. The dimension may be a width and/or thickness.

The male interlocking portion may be provided at the flow control module and the female interlocking portion may be provided at the mounting bracket.

Opposing surfaces of the male and female interlocking portions may comprise complementary protrusions and indentations which are configured to provide tactile confirmation of the proper engagement of the mounting bracket and the flow control module.

The flow control module may further comprise a tray which receives and retains the gasket.

The gasket may be a planar sheet comprising at least a portion formed from a compressible material.

The flow control module may further comprise a lifting rod which is rotatably coupled to the flow control module, the lifting rod having a cam which projects radially from the lifting rod and is disposed adjacent the flow control module; wherein the mounting bracket comprises a slot sized to receive the cam, the cam being inserted and removed by rotating the lifting rod.

The lifting rod may be threadably coupled to the flow control module, and relative positions and dimensions of the cam and the slot may prevent decoupling of the lifting rod from the flow control module when the flow control module is installed in the mounting bracket.

The opening of the gasket may be sized to define desired hydraulic characteristics of the flow control module.

The mounting bracket may be profiled to conform to the wall of the collection chamber.

In accordance with another aspect of the invention, there is provided a kit of parts for forming a flow control assembly as described above, the kit of parts comprising: a mounting bracket; a flow control module; and a gasket.

The gasket may be a continuous sheet comprising at least a portion formed from a compressible material through which an appropriately sized opening can be formed to provide desired hydraulic characteristics for the flow control module.

The gasket may comprise a series of guidelines for forming openings of different sizes.

The kit of parts may comprise a plurality of gaskets, each gasket being provided with an opening extending therethrough, the plurality of gaskets having openings of different sizes.

In accordance with another aspect of the invention, there is provided a method of installing a flow control assembly as described above, the method comprising: attaching a mounting bracket to a wall of a collection chamber; and coupling a flow control module to the mounting bracket with a gasket disposed therebetween.

The method may further comprise: forming an opening in the gasket of appropriate size so as to provide desired hydraulic characteristics for the flow control module.

The opening may be formed by cutting a hole in a sheet comprising at least a portion formed from a compressible material.

The method may further comprise: selecting the gasket from a plurality of gaskets having different sized openings, the gasket being selected to provide desired hydraulic characteristics for the flow control module.

In accordance with another aspect of the invention, there is provided a vortex flow control assembly comprising: a mounting bracket attachable to a wall of a chamber, the mounting bracket having an opening extending therethrough; a vortex flow control module detachably coupled to the mounting bracket, the vortex flow control module having a vortex flow control device comprising an inlet and an outlet, the outlet being aligned with the opening of the mounting bracket; wherein the mounting bracket and the flow control module are detachably coupled by a connection comprising male and female interlocking portions; and wherein opposing surfaces of the male and female interlocking portions comprise complementary protrusions and indentations which are configured to provide tactile confirmation of the proper engagement of the mounting bracket and the flow control module.

BRIEF DESCRIPTION OF THE DRAWINGS

For a better understanding of the present disclosure, and to show more clearly how it may be carried into effect, reference will now be made, by way of example, to the accompanying drawings, in which.

DETAILED DESCRIPTION

Figure 1:
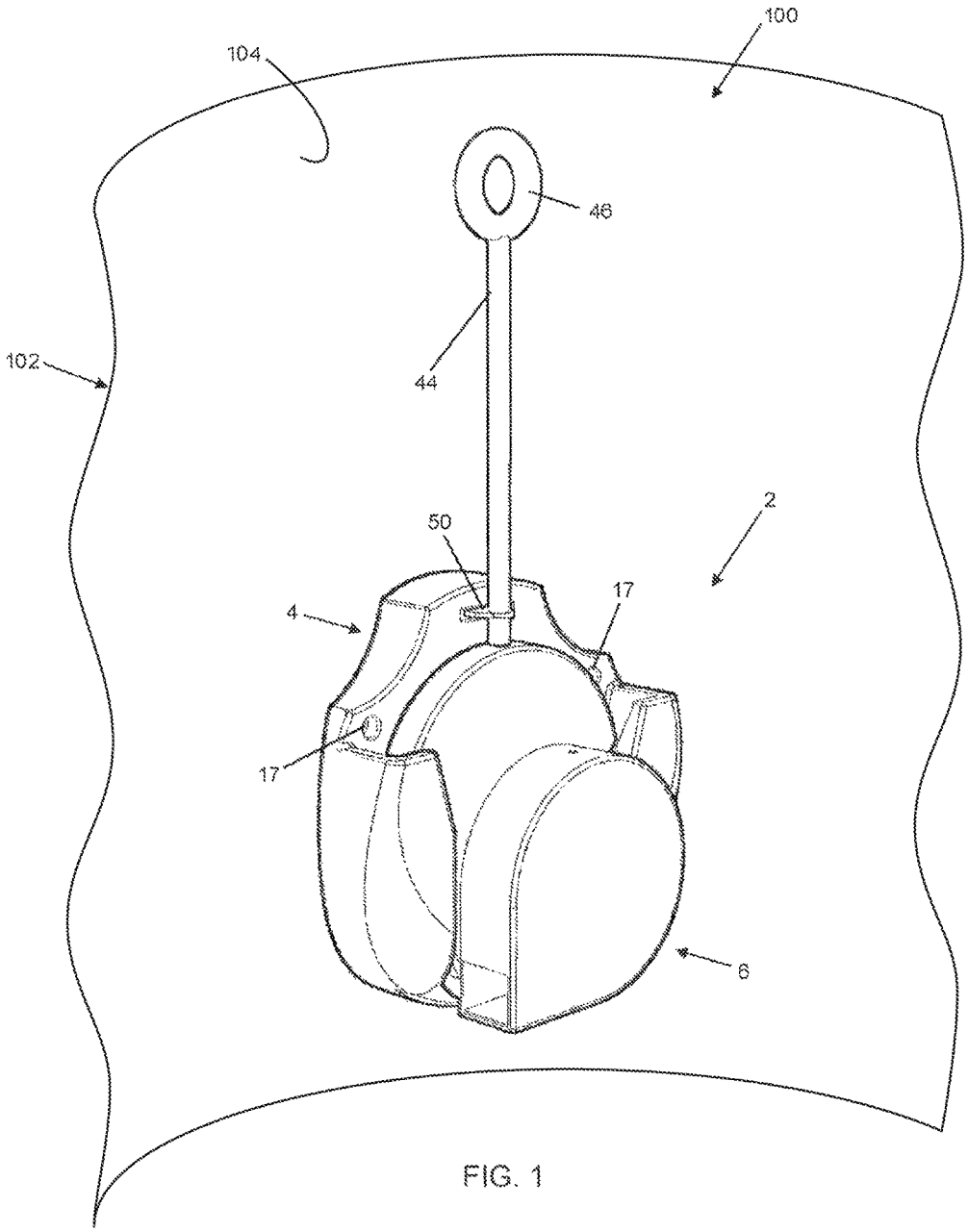
FIG. 1 is a perspective view of a vortex flow control assembly according to an embodiment of the invention.

FIG. 1 shows a vortex flow control assembly 2 according to an embodiment of the invention. The assembly 2 comprises a mounting bracket 4 and a vortex flow control module 6. The mounting bracket 4 and the vortex flow control module 6 are formed as separate components, but can be interconnected with one another, as will be described in detail below. The mounting bracket 4 and the vortex flow control module 6 are preferably molded plastic components, but may, alternatively, be formed from metal or other materials.

The mounting bracket 4 will now be described in detail with respect to FIGS. 2 and 3. As shown, the mounting bracket 4 comprises a downstream surface 8 and an upstream surface 10. A conduit 12 passes through the mounting bracket 4 from the downstream surface 8 to the upstream surface 10.

The upstream surface 10 comprises a pair of jaws 14*a*, 14*b* which project from the upstream surface 10. The jaws 14*a*, 14*b* are substantially diametrically opposed from one another across the conduit 12. Each jaw 14*a*, 14*b* comprises a groove 16*a*, 16*b* which extends parallel to the plane of the upstream surface 10. The grooves 16*a*, 16*b* of the jaws 14*a*, 14*b* oppose one another, and thus define a throat (or slot) between the opposing jaws 14*a*, 14*b*. The grooves 16*a*, 16*b* are angled with respect to one another. Specifically, the grooves 16*a*, 16*b* converge towards one another below the mounting bracket 4, such that the width of the throat tapers towards the lower end of the throat. The throat represents a female portion of a connection with the vortex flow control module 6, as will be described in more detail below.

With reference to FIG. 1, in use, the mounting bracket 4 is affixed against an inner surface 104 of a wall 102 of a collection chamber 100, such as in a gully or manhole, so that the downstream surface 8 bears against the inner surface 104 of the chamber wall 102 and the upstream surface 10 is spaced from the chamber wall 102. A plurality of mounting holes 17 which extend through the thickness of the mounting bracket 4 are provided for attachment of the mounting bracket 4 to the chamber wall 102.

The downstream surface 8 of the mounting bracket 4 is designed to conform to the inner surface 104 of the chamber wall 102. Such chambers 100 are typically cylindrical and thus, as shown in FIG. 3, the downstream surface 8 is profiled so as to conform to the curvature of the inner surface 104 of the chamber wall 102. Of course, where the mounting bracket 4 is to be affixed to a planar surface (for example, where the collection chamber 100 has a square cross-section or is provided with a planar shuttered wall 102), the downstream surface 8 may itself be planar.

The mounting bracket 4 is positioned within the collection chamber such that the conduit 12 is aligned with an outlet provided through the chamber wall. The conduit 12 thus provides an extension of the outlet.

Figure 4:
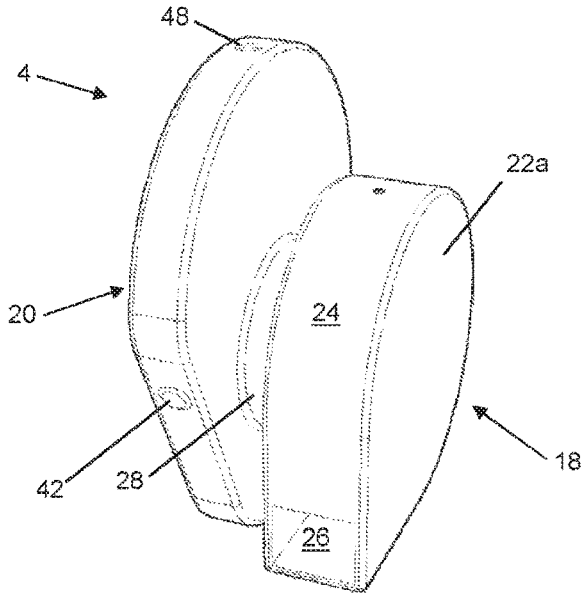
FIG. 4 is a front perspective view of a vortex flow control module of the assembly.
Figure 5:
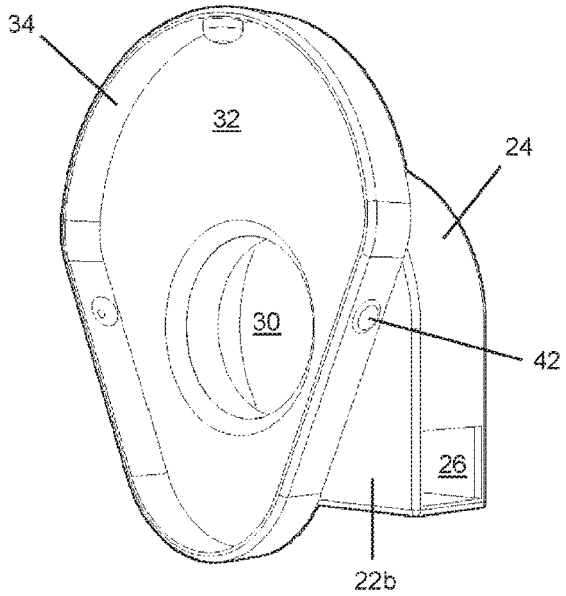
FIG. 5 is a rear perspective view of the vortex flow control module of FIG. 4.
Figure 6:
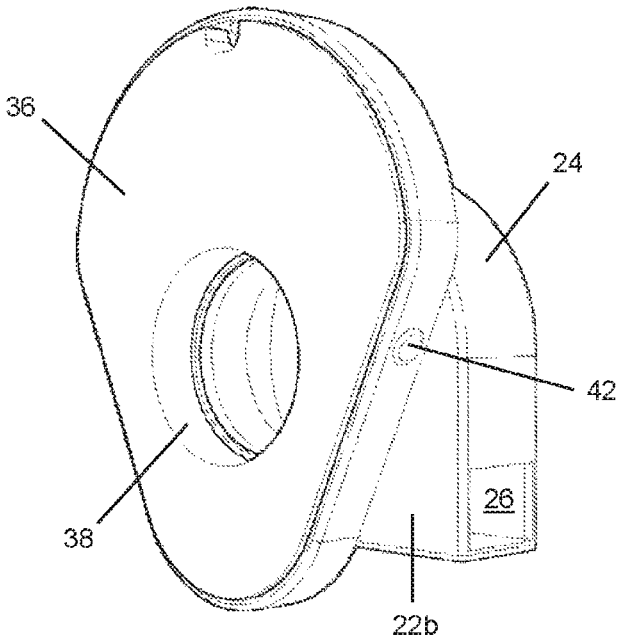
FIG. 6 shows the vortex flow control module with an intermediate gasket installed.

The vortex flow control module 6 will now be described in detail with respect to FIGS. 4 to 6. As shown, the vortex flow control module 6 generally comprises a vortex flow control device 18 and a mounting element 20.

The vortex flow control device 18 comprises a vortex chamber. The vortex chamber is defined by a pair of planar walls 22*a*, 22*b* which are arranged parallel to one another and a shaped outer wall 24 which is disposed between the planar walls 22*a*, 22*b* and extends about their perimeter edges. A rectangular inlet 26 is provided between ends of the outer wall 24 and adjacent portions of the planar walls 22*a*, 22*b*. The inlet 26 is substantially tangential to the vortex chamber so as to impart a circulating flow within the vortex chamber which, at a sufficiently high flow rate, generates a vortex within the vortex chamber.

The vortex flow control device 18 and the mounting element 20 are connected to one another by a conduit 28 which extends from the planar wall 22*b* (the wall adjacent the collection chamber) to the mounting element 20. The conduit 28 defines a passageway 30 from the vortex flow control device 18 to the mounting element 20. The passageway 30 forms part of the volume of the vortex chamber. The conduit 28 is sufficiently long so as to allow a portion of each jaw 14*a*, 14*b* to be received between the vortex flow control device 18 and the mounting element 20.

The mounting element 20 comprises an end wall 32 and a side wall 34 which surrounds the end wall 32. The side wall 34 projects perpendicularly away from the end wall 32 and the vortex flow control device 18. The end wall 32 and the side wall 34 of the mounting element 20 define a tray which, as shown in FIG. 6, is configured to receive a gasket 36 comprising at least a portion formed from a compressible material. For example, the gasket 36 may be a composite component which has a layer or section formed from a suitable compressible material.

The gasket 36 is shaped to fit within the outline defined by the side wall 34. The gasket 36 fits tightly within the side wall 34 such that it is retained by the side wall 34. The gasket 36 has an uncompressed thickness which is greater than the height of the side wall 34 and thus sits proud of the side wall 34. The gasket 36 has an opening 38 extending therethrough which is positioned in the gasket 36 so that it generally aligns (i.e. overlaps) with the conduit 28 and the passageway 30 when the gasket 36 is located within the tray.

The opening 38 of the gasket 36 has a diameter which is smaller than that of the conduits 12, 28 of the mounting bracket 4 and the vortex flow control module 6. The gasket 36 therefore defines the outlet flow passage of the vortex flow control device 18 and restricts flow out of the vortex flow control device 18. The opening 38 can therefore be sized to provide the desired hydraulic characteristics for the vortex flow control device 18.

The mounting element 20 has a complementary size and shape to the throat of the mounting bracket 4 and forms a male portion of the connection. Specifically, the mounting element 20 is cam-shaped and its width tapers towards the lower end of the mounting element 20. The taper of the mounting element 20 substantially corresponds to that of the throat of the mounting bracket 4. Further, the side wall 34 of the mounting element 20 has a height which is slightly smaller than the width of the grooves 16*a*, 16*b* formed in the jaws 14*a*, 14*b* of the mounting bracket 4.

The mounting element 20 can therefore be received by the throat of the mounting bracket 4 by introducing the mounting element 20 into the throat of the mounting bracket 4 from above.

The corresponding tapers of the mounting bracket 4 and the mounting element 20 cause the side wall 34 of the mounting element 20 to abut against the opposing surfaces of the grooves 16*a*, 16*b*. This ensures that the vortex flow control module 6 automatically seats into the correct position as it is lowered into the mounting bracket 4 during installation.

Figure 2:
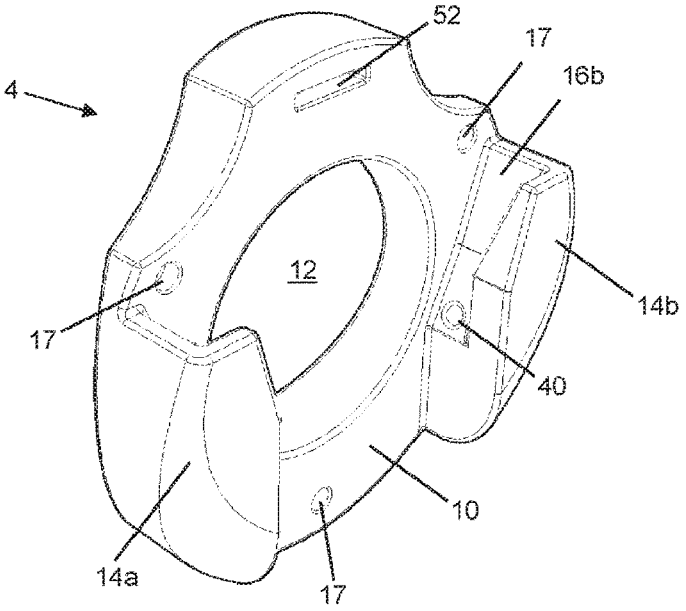
FIG. 2 is a front perspective view of a mounting bracket of the vortex flow control assembly.
Figure 3:
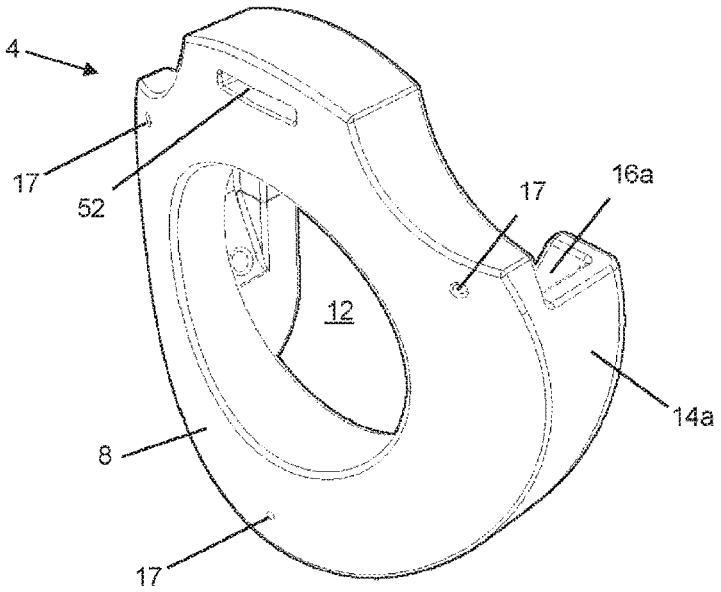
FIG. 3 is a rear perspective view of the mounting bracket of FIG. 2.

The opposing surfaces of the grooves 16*a*, 16*b* are each provided with an indentation 40 (see FIG. 2). Conversely, the side wall 34 of the mounting element 20 is provided with a complementary pair of protrusions 42 which project from an outer surface of the side wall 34 and are provided at opposite sides of the end wall 32.

The indentations 40 of the mounting bracket 4 and the protrusions 42 of the mounting element 20 are arranged such that they align with one another when the side wall 34 of the mounting element 20 comes into abutment with the opposing surfaces of the grooves 16*a*, 16*b*. In this position, the protrusions 42 can be received by the indentations 40 which provides a tactile confirmation that the mounting element 20 has been properly seated in the mounting bracket 4.

As described above, the gasket 36 has an uncompressed thickness which is greater than the height of the side wall 34 and thus sits proud of the side wall 34. Accordingly, as the mounting element 20 is introduced into the mounting bracket 4, the gasket 36 is compressed between the end wall 32 of the mounting element 20 and the upstream surface 10 of the mounting bracket 4. The gasket 36 thus seals the vortex flow control module 6 against the mounting bracket 4. As described previously, the gasket 36 is gripped by the tray of the mounting element 20 so as to prevent it from falling out as the vortex flow control module 6 is raised and lowered relative to the mounting bracket 4.

As shown in FIG. 1, the vortex flow control module 6 is carried by a lifting rod 44 which extends vertically away from the vortex flow control module 6. An upper, free end of the lifting rod 44 is provided with a lifting eye 46 which can be used to lift the vortex flow control module 6 into and out of the collection chamber so as to engage or disengage the mounting bracket 4. This may be performed using a suitable hoist arrangement. The lifting rod 44 is preferably sufficiently long so that it sits just below the top of the collection chamber and is easily accessible via a manhole cover or the like.

The lifting rod 44 is detachably coupled to the mounting element 20 of the vortex flow control module 6 by a threaded connection. Specifically, the mounting element 20 is provided with a threaded insert 48 (see FIG. 4) which is received by the side wall 34. The threaded insert 48 receives a threaded end of the lifting rod 44 which is introduced into the threaded insert 48 by rotating the lifting rod 44 about its longitudinal axis. The vortex flow control module 6 can therefore be stored and supplied without the lifting rod 44 attached so as to reduce its size, with the lifting rod 44 being coupled to the mounting element 20 prior to the installation of the vortex flow control module 6. It will be appreciated that this arrangement could be reversed so that the female threaded portion is provided at the lifting rod 44 and the male threaded portion is provided at the mounting element 20.

A lower end of the lifting rod 44 is provided with a cam 50 which projects radially out of the lifting rod 44. The cam 50 is spaced a short distance from the top of the mounting element 20. As shown in FIGS. 2 and 3, the mounting bracket 4 comprises a horizontal slot 52 which, when the vortex flow control module 6 is properly received by the mounting bracket 4, is aligned with the cam 50. The lifting rod 44 can be rotated relative to the vortex flow control module 6 by inserting or withdrawing the threaded end of the lifting rod 44 into or from the threaded insert 48 such that the cam 50 is received within the slot 52 of the mounting bracket 4. In this orientation, the cam 50 prevents the mounting element 20 from being withdrawn from the throat of the mounting bracket 4 and thus locks the position of the vortex flow control module 6 relative to the mounting bracket 4. If the vortex flow control module 6 is to be extracted from the mounting bracket 4, the lifting rod 44 can be rotated (in either direction) so as to withdraw the cam 50 from the slot 52, thereby allowing the vortex flow control module 6 to be lifted vertically out of the mounting bracket 4.

The relative vertical dimensions and positions of the cam 50 and the slot 52 are configured so as to prevent the threaded end of the lifting rod 44 from being completely withdrawn from the threaded insert 48. Specifically, the distance between the top of the threaded insert 48 and the top of the slot 52 is smaller than the distance between the bottom of the threaded end of the lifting rod 44 and the top of the cam 50. Consequently, the cam 50 prevents further rotation of the lifting rod 44 through contact with the mounting bracket 4 (i.e. at the top of the slot 52 or above). Removal of the lifting rod 44 is thus prevented once the vortex flow control module 6 is installed in the mounting bracket 4. This ensures that the lifting rod 44 is present to allow removal of the vortex flow control module 6.

With the vortex flow control module 6 installed in the mounting bracket 4, the vortex flow control assembly 2 can be used to control the flow of water through the collection chamber. Specifically, water can enter the inlet 26 of the flow control device 18 and pass into the passageway 30 between the vortex flow control device 18 and out of the outlet of the collection chamber via the opening 38 in the gasket 36 and the conduit 12 of the mounting bracket 4.

At low flow rates, water passes through the vortex chamber without obstruction and thus with substantially no pressure drop. However, at high flow rates, water enters through the inlet 26 with enough energy to create a vortex in the vortex chamber which restricts flow through the passageway 30 of the vortex chamber and results in a significant pressure drop. Therefore, the vortex flow control device 18 automatically limits the rate of flow.

As described previously, the gasket 36 has two primary functions. Firstly, the gasket 36 seals the vortex flow control module 6 against the mounting bracket 4 and thus prevents water from leaking back into the collection chamber at the connection between the vortex flow control module 6 and the mounting bracket 4. Secondly, the gasket 36 defines the outlet of the vortex flow control device 18 and thus allows the hydraulic characteristics of the vortex flow control device 18 to be easily tailored to the specific installation.

The gasket 36 may be supplied without the opening 38. Instead, an opening 38 of suitable diameter can be cut from the gasket 36 during installation of the vortex flow control assembly 2 based on the expected flow conditions. The gasket 36 may be provided with a series of guidelines to assist with cutting an appropriately sized opening 38 from the gasket 36. Alternatively, a plurality of gaskets 36 may be supplied with the vortex flow control assembly 2, each having a different sized opening 38.

Conventionally, alterations to the characteristics of vortex flow control devices may be made by physically altering the geometry of the vortex flow control device itself. Such alterations are often costly and time-consuming, and are not easily reversible.

In contrast, the gasket 36 allows the characteristics of the vortex flow control device 18 to be quickly and easily altered. The vortex flow control module 6 can therefore be manufactured and supplied in a standard size (or a more limited range of sizes), with adjustment being provided by the gasket 36. Changes to the size of the opening 38 in the gasket 36 can be made before or after installation by cutting an opening 38 of larger diameter or by replacing the gasket 36 (particularly when the diameter of the opening 38 must be reduced). The gasket 36 is a relatively inexpensive component and can therefore be replaced whenever necessary.

Although the invention has been described with reference to a vortex flow control assembly having a vortex flow control module, it may be applied with similar benefits in other assemblies. For example, a similar two-piece construction may be used to attach a filter module to the wall of a collection chamber. The gasket 36 may be provided between the filter module and the mounting bracket to both seal the filter module to the mounting bracket and to customize the hydraulic characteristics of the filter module. For example, where the chamber wall provides an outlet for the filter module, the opening 38 in the gasket 36 may throttle the flow to the outlet and thus define the residence time of the water within the filter unit. However, it will be appreciated that other flow control modules may also benefit from the construction employed by the invention.

Where the flow control module comprises a vortex flow control device, it may have a different construction to that shown and described above. In particular, in some embodiments, the vortex chamber may be conical.

In contrast to the arrangement shown and described above, the connection between the vortex flow control module 6 and the mounting bracket 4 may also be formed such that the female portion is provided at the vortex flow control module 6 and the male portion is provided at the mounting bracket 4. The vortex flow control module 6 and the mounting bracket 4 may also be connected by other means than that shown. It is, however, preferred that a tray is provided at the vortex flow control module 6 for housing the gasket 36 so that the gasket 36 is carried by the vortex flow control module 6 as it is lowered into or raised out of the collection chamber. This allows the gasket 36 to be modified or replaced from ground level.

Although the mounting bracket 4 has been described as having indentations 40 and the mounting element 20 has been described as having protrusions 42, this arrangement could of course be reversed. Furthermore, additional indentations 40 and protrusions 42 may be provided. In this case, the mounting bracket 4 and the mounting element 20 may each be provided with both indentations 40 and protrusions 42. It is, however, desirable that the indentations 40 and protrusions 42 are provided in opposing pairs on either side of the mounting bracket 4 and the mounting element 20 in order to ensure proper alignment. Moreover, tactile confirmation may be provided by other complementary features and is not strictly limited to the indentations 40 and protrusions 42 shown and described herein.

As described previously, the widths of the mounting element 20 and the throat of the mounting bracket 4 taper in order to ensure that the vortex flow control module 6 automatically seats into the correct position as it is lowered into the mounting bracket 4 during installation. This arrangement aligns the vortex flow control module 6 and the mounting bracket 4 in a first plane. In addition, or instead, the thickness of the mounting element 20 and the throat of the mounting bracket 4 may taper so as to align the vortex flow control module 6 and the mounting bracket 4 in a second plane which is perpendicular to the first plane.

The invention is not limited to the embodiments described herein, and may be modified or adapted without departing from the scope of the present invention.

The invention claimed is:

1. A flow control assembly comprising:

a mounting bracket defining an opening extending therethrough;

a fluid directing body detachably coupled to the mounting bracket, wherein the fluid directing body includes an inlet and an outlet, the outlet being aligned with the opening of the mounting bracket; and a gasket having an opening extending therethrough, the opening being smaller than the outlet of the fluid directing body and the opening of the mounting bracket;

wherein the gasket is disposed between the fluid directing body and the mounting bracket so as to seal the fluid directing body against the mounting bracket, with the opening of the gasket aligned with the outlet of the fluid directing body and the opening of the mounting bracket so as to restrict flow out of the fluid directing body;

wherein the mounting bracket and the fluid directing body are detachably coupled by a connection comprising male and female interlocking portions; and wherein the female interlocking portion comprises a receiving slot and the male interlocking portion comprises a complementary mounting element that is slidably received within the receiving slot.

2. The flow control assembly as claimed in claim 1, wherein the fluid directing body defines a vortex chamber in fluid communication with the inlet and the outlet.

3. The flow control assembly as claimed in claim 1, wherein the female interlocking portion includes a pair of jaws that are spaced from one another to define an open throat therebetween, wherein each of the jaws includes a groove, the grooves opposing one another to define the receiving slot.

4. The flow control assembly as claimed in claim 1, wherein the receiving slot and mounting element each taper along their length such that a lower portion has a smaller dimension than an upper portion.

5. The flow control assembly as claimed in claim 4, wherein the dimension is a width or thickness.

6. The flow control assembly as claimed in claim 1, wherein the male interlocking portion is provided by the fluid directing body and the female interlocking portion is provided by the mounting bracket.

7. The flow control assembly as claimed in claim 1, wherein the male and female interlocking portions include opposing surfaces having complementary protrusions and indentations that are configured to provide tactile confirmation of engagement of the mounting bracket and the fluid directing body.

8. The flow control assembly as claimed in claim 1, wherein the fluid directing body further includes:

a tray that receives and retains the gasket.

9. The flow control assembly as claimed in claim 1, wherein the gasket is a planar sheet, wherein at least a portion of the planar sheet is formed from a compressible material.

10. The flow control assembly as claimed in claim 1, wherein the fluid directing body further includes:

a lifting rod that is rotatably coupled to the fluid directing body, wherein the lifting rod includes a cam that projects radially from the lifting rod and is disposed adjacent the fluid directing body, wherein the mounting bracket includes a slot sized to receive the cam, wherein the cam is inserted and removed by rotating the lifting rod.

11. The flow control assembly as claimed in claim 10, wherein the lifting rod is threadably coupled to the fluid directing body, wherein relative positions and dimensions of the cam and the slot prevent decoupling of the lifting rod from the fluid directing body when the fluid directing body is installed in the mounting bracket.

12. The flow control assembly as claimed in claim 1, wherein the opening of the gasket is sized to define hydraulic characteristics of the fluid directing body.

13. The flow control assembly as claimed in claim 1, wherein the mounting bracket is profiled to conform to a wall of the collection chamber.

14. The flow control assembly as claimed in claim 1, wherein the fluid directing body defines a filter chamber in fluid communication with the inlet and the outlet.

15. A method of installing the flow control assembly of claim 1, the method comprising:

attaching the mounting bracket to a wall of a collection chamber; and coupling the fluid directing body to the mounting bracket with the gasket disposed therebetween.

16. The method of claim 15, further comprising:

forming the opening of the gasket to a size so as to provide hydraulic characteristics for the fluid directing body.

17. The method of claim 16, wherein the opening of the gasket is formed by:

cutting a hole in a sheet defining the gasket, wherein at least a portion of the sheet is formed from a compressible material.

18. The method of claim 15, further comprising:

selecting the gasket from a plurality of gaskets having different sized openings, wherein the selected gasket provides desired hydraulic characteristics for the fluid directing body.

19. A flow control assembly configured for attachment to a wall of a collection chamber, the flow control assembly comprising:

a kit of parts including:

a mounting bracket a fluid directing body; and a gasket, wherein the mounting bracket is configured for attachment to the wall of the collection chamber, wherein the mounting bracket defines an opening extending therethrough;

wherein the fluid directing body is configured to be detachably coupled to the mounting bracket, wherein the fluid directing body defines an inlet and an outlet, wherein the outlet is aligned with the opening of the mounting bracket; and wherein the gasket defines an opening extending therethrough, wherein the opening is smaller than the outlet of the fluid directing body and the opening of the mounting bracket;

wherein the gasket is configured to be disposed between the fluid directing body and the mounting bracket so as to seal the fluid directing body against the mounting bracket with the opening of the gasket aligned with the outlet of the fluid directing body and the opening of the mounting bracket so as to restrict flow out of the fluid directing body;

wherein the mounting bracket and the fluid directing body are detachably coupled by a connection defined by male and female interlocking portions; and wherein the female interlocking portion is defined by a receiving slot, wherein the male interlocking portion is defined by a complementary mounting element that is slidably received within the receiving slot.

20. The flow control assembly as claimed in claim 19, wherein the gasket is a continuous sheet, wherein at least a portion of the continuous sheet is formed from a compressible material, wherein the opening of the gasket is formed to provide hydraulic characteristics for the fluid directing body.

21. The flow control assembly as claimed in claim 20, wherein the gasket defines a series of guidelines for forming a gasket opening of a plurality of differently sized gasket openings.

22. The flow control assembly as claimed in claim 20, wherein the kit of parts comprises:

a plurality of gaskets, wherein each gasket is provided with an opening extending therethrough, wherein each opening of the plurality of gaskets is differently sized.

23. The flow control assembly as claimed in claim 19, wherein the fluid directing body defines a vortex chamber in fluid communication with the inlet and the outlet.

24. The flow control assembly as claimed in claim 19, wherein the fluid directing body defines a filter chamber in fluid communication with the inlet and the outlet.

25. A vortex flow control assembly comprising:

a mounting bracket configured for attachment to a wall of a chamber, wherein the mounting bracket defines an opening extending therethrough; and a fluid directing body defining a vortex chamber detachably coupled to the mounting bracket, wherein the fluid directing body defines an inlet and an outlet, wherein the outlet is aligned with the opening of the mounting bracket;

wherein the mounting bracket and the fluid direction body are detachably coupled by a connection defined by male and female interlocking portions; and wherein opposing surfaces of the male and female interlocking portions define complementary protrusions and indentations that are configured to provide tactile confirmation of engagement of the mounting bracket and the fluid directing body.

* * * * *